United States Patent [19]

Bader, Jr. et al.

[11] 4,129,256

[45] Dec. 12, 1978

[54] ELECTROMAGNETIC UNIT FUEL INJECTOR

[75] Inventors: Ernest Bader, Jr.; John I. Deckard; Dan B. Kuiper, all of Grand Rapids, Mich.

[73] Assignee: General Motors Corporation, Detroit, Mich.

[21] Appl. No.: 832,074

[22] Filed: Sep. 12, 1977

[51] Int. Cl.[2] ..... F02M 47/02; F02M 55/00

[52] U.S. Cl. ..... 239/96; 123/139 AK; 123/139 E; 239/58 S

[58] Field of Search ..... 239/88–91, 239/93–96, 124, 533.5, 533.9, 585; 123/32 AE, 139 AE, 139 AK, 139 E

[56] References Cited

U.S. PATENT DOCUMENTS

| | | | |
|---|---|---|---|
| 3,006,556 | 10/1961 | Shade et al. | 239/90 X |
| 3,464,627 | 9/1969 | Huber | 239/96 |
| 3,777,977 | 12/1973 | Regneault et al. | 239/585 X |

*Primary Examiner*—Evon C. Blunk

*Assistant Examiner*—Andres Kashnikow

*Attorney, Agent, or Firm*—Arthur N. Krein

[57] ABSTRACT

An electromagnetic unit fuel injector for use in a diesel engine has a pump, provided by a cam actuated plunger reciprocable in a bushing, for intensifying the pressure of fuel delivered to a spring biased closed, pressure actuated injection valve controlling flow discharge out through a spray outlet, to a pressure accumulator and through a throttling orifice passage into one end of a modulation pressure control chamber having an enlarged diameter stem portion of the injection valve therein, the modulation pressure control chamber downstream of the throttling orifice passage being connected by a conduit including a solenoid actuated valve controlling metering orifice with a low pressure fuel drain return line whereby the pressure of fuel in the modulation pressure control chamber acting on the enlarged diameter stem portion of the injection valve is modulated so as to control the seating and unseating of the injection valve.

5 Claims, 7 Drawing Figures

ELECTROMAGNETIC UNIT FUEL INJECTOR

FIELD OF THE INVENTION

This invention relates to unit fuel injectors of the type used for injecting fuel into the cylinder of a diesel engine and, in particular, to an electromagnetic unit fuel injector.

DESCRIPTION OF THE PRIOR ART

Unit fuel injectors of the so-called jerk-type used for the pressure injection of liquid fuel into the cylinder of a diesel engine are well known and include in one unit a cam actuated pump in the form of a plunger and bushing for pressurizing fuel to a relatively high pressure to effect unseating of a pressure actuated injection valve in the fuel delivery injection valve or nozzle assembly of such a unit injector. In the unit fuel injectors now commonly in use, the plunger of the pump is not only reciprocated, but it can also be rotated about its axis by means of a rack in mesh with a gear through which the plunger reciprocates whereby to control the fuel output of the injector by changing the relation of the usual helices provided on the plunger of such a unit relative to the fuel passage ports in the bushing. The plunger helices of such units have an injection timing function in addition to their metering function. As is well known, the helices of the plunger may be machined, as desired, so as to vary the time of injection at various loads with respect to the engine piston position. With such an arrangement, either or both beginning and ending of injection may be retarded, advanced, or maintained constant with an increase in injector output, depending upon engine requirements. This feature of such injectors limits a particular injector to one engine family class for which the injector has been designed and, of course, the particular shape of the helices on its plunger controls the operation of that injector in a fixed predetermined manner.

SUMMARY OF THE INVENTION

The present invention provides an electromagnetic unit fuel injector that includes a modulation pressure control chamber supplied with fuel from the engine cam actuated pump assembly of the unit through a throttling orifice and which is connected by an electromagnetic valve controlled modulated pressure fuel passage, having a metering orifice therein, to a low pressure fuel return line, the modulated fuel pressure provided in the control chamber acting on the spring biased, pressure actuated injection valve controlling the discharge of fuel out through the spray tip outlet of the fuel injection nozzle assembly of this unit. Fuel at an intensified high pressure, as supplied by the pump assembly, is stored in the accumulator chamber so that injection of fuel is controlled by operation of the electromagnetic valve whereby to provide quality, pressurerate control characteristics and pilot injection, as desired.

It is therefore the primary object of this invention to improve a unit fuel injector which is operative to reduce undesirable engine emissions, specifically unburned hydrocarbons, by permitting the electronic advancing, by actuation of an electromagnet valve, to effect the beginning of injection of the pilot and main charges independently with respect to engine revolutions per minute and load, and the nitrogen oxides by controlling the initial heat release by reducing fuel injected in the ignition delay period.

It is another object of the invention to improve a unit fuel injector for use in a diesel engine which is operative so as to effect a reduction of engine noise and mechanical stresses by the control of the injection rate profile of the main injection charge, with the flexible characteristics of pilot injection, if desired.

For a better understanding of the invention, as well as other objects and further features, reference is had to the following detailed description of the invention to be read in connection with the accompanying drawings.

DESCRIPTION OF THE PREFERRED EMBODIMENT

Figure 1:
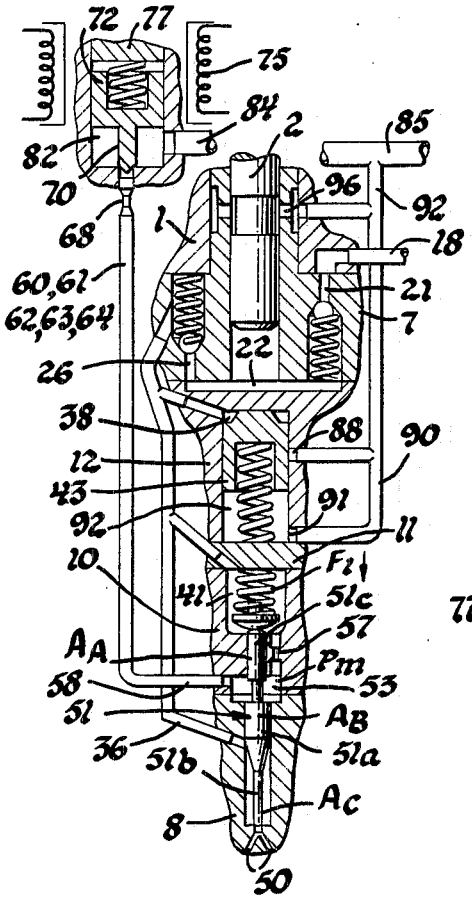
FIG. 1 is a schematic illustration of the primary operating elements of an electromagnetic unit fuel injector in accordance with the invention.

Referring now to the drawings and, in particular, to FIGS. 2 through 7, inclusive, there is shown an electromagnetic unit fuel injector in accordance with the invention, that is, in effect, a unit fuel injector-pump assembly with a solenoid valve incorporated therein to control fuel discharged from the injector portion of this assembly. As shown, the electromagnetic unit fuel injector includes a hollow body or housing 1 having a pump plunger 2 and a plunger actuated follower 3 reciprocally mounted therein. The follower 3 extends out one end of the housing 1 whereby it and the plunger connected thereto are adapted to be reciprocated by an engine driven cam or rocket, not shown, and by a plunger return spring 4 in a conventional manner, a stop pin 5 extending through the housing to limit upward travel of the follower 3.

Forming an extension of and threaded to the lower end of the housing 1 is a nut 6 within which is supported a bushing-cage 7 with a through bore 7*a* therethrough to provide the pump cylinder for the plunger 2, this bushing-cage hereinafter being referred to as the bushing 7. The bushing 7 is of external stepped configuration whereby its upper end is supported within the housing 1.

Nut 6 has an opening 6*a* at its lower end through which extends the lower end of the combined injection spray tip and valve body 8, hereinafter referred to as the valve body, of a fuel injector nozzle assembly. As shown, the valve body 8 is enlarged at its upper end to provide a shoulder 8*a* which seats on an internal shoulder 6*b* provided by the through counterbore in nut 6. Between the valve body 8 and the bushing 7 there is positioned, in sequence starting from the valve body, a modulation pressure control and spring cage 10, a cross-over cage 11 and an accumulator cage 12, these elements being formed, in the construction illustrated, as separate elements for ease of manufacturing and assembly. The threaded connection 14 of the nut 6 to housing 1 holds the valve body 8, modulation pressure control and spring cage 10, cross-over cage 11 and accumulator cage 12 clamped and stacked end-to-end between the upper face 8*b* of valve body 8 and the bottom face 7*b* of bushing 7. All of these above described elements have lapped mating surfaces whereby they are held in pressure sealed relation to each other and, in addition, dowels, not shown, are used to maintain the desired, aligned, position of these elements relative to each other in a manner well known in the art.

Figure 4:
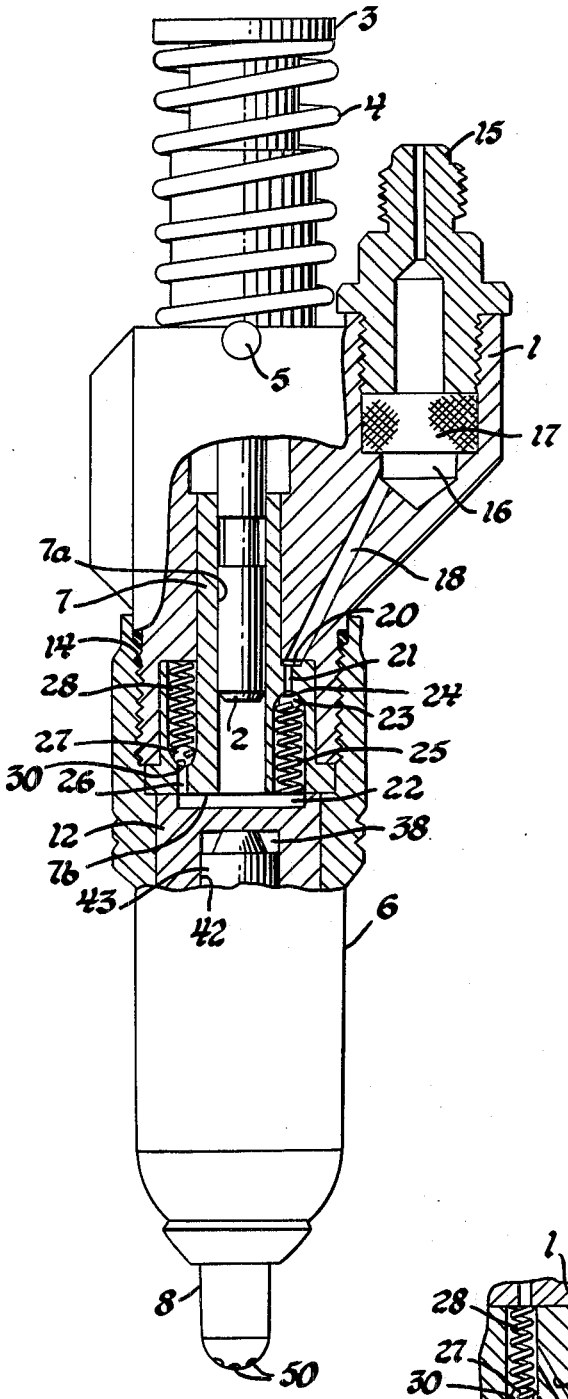
FIG. 4 is a sectional view taken along line 4—4 of FIG. 3.

Fuel as from a fuel tank via a supply pump and conduit, not shown, is supplied to the lower open end of the bushing 7 by a fuel supply passage means which includes an apertured inlet or supply fitting 15, as best seen in FIG. 4, fixed to the housing 1 that leads to a filter chamber 16 provided within the housing containing a filter 17. The outlet from the filter chamber 16 communicates via a passage 18 in housing 1 with a recessed channel 20 in the upper end of bushing 7 and then via a stepped passage 21 through the bushing to a recessed cavity 22 provided in the upper end of the accumulator cage 12, this cavity 22 being in flow communication with the lower open end of the bushing 7. Flow through the inlet passage means is controlled by a one-way check valve shown in the form of a ball 23 positioned in the enlarged portion of the passage 21 and which is biased into seating engagement against a valve seat 24 within this passage by a compression spring 25 so that, during a suction stroke of plunger 2, fuel can be drawn into the pump cylinder through the open end of the bushing.

Figure 5:
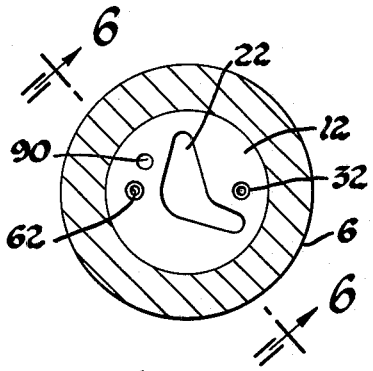
FIG. 5 is a sectional view taken along line 5—5 of FIG. 2.
Figure 7:
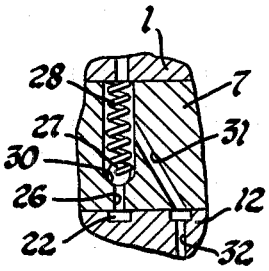
FIG. 7 is a partial sectional view of the bushing and accumulator cage of the injector rotated with respect to its position shown in FIG. 4 to further show the discharge flow path of fuel.

During a pump stroke of plunger 2, fuel is discharged from the open end of the bushing at an intensified pressure into the recessed cavity 22 which is of a configuration, as shown in FIG. 5, so as to also be in communication with one end of an intensified fuel or discharge passage means that includes a passage 26, provided in the bushing 7, with flow therethrough controlled by a one-way check valve that includes a ball 27 and a spring 28 which normally biases the ball 27 into seating engagement with its cooperating valve seat 30. The discharge passage means further includes, as shown in FIG. 7, a downwardly directed passage 31 in bushing 7 which at one end intersects the passage 26 downstream of ball 27 and which at its other end opens into the enlarged end of a stepped passage 32 provided in the accumulator cage 12. This latter passage 32 is in communication with a stepped through passage 33 in cross-over cage 11, a passage 34 through modulation pressure control and spring cage 10 opening into an annular groove 35 at the lower end of the cage 10 which is in communication with the drilled fuel passages 36 in valve body 8, whereby fuel at an intensified fuel pressure is supplied to the fuel injector nozzle assembly for discharge into the combustion cylinder of an engine, not shown.

Figure 2:
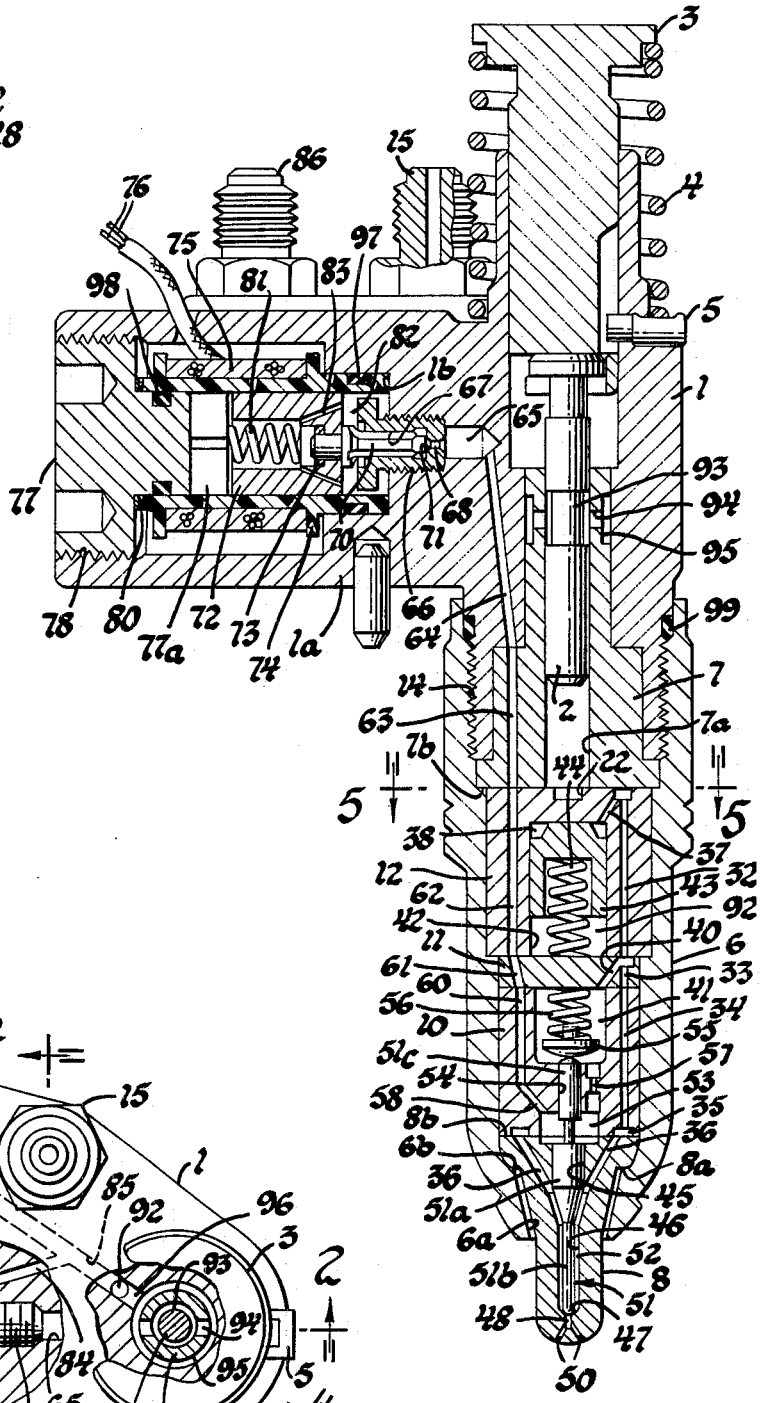
FIG. 2 is a longitudinal, sectional view of an electromagnetic unit fuel injector in accordance with the invention, this view being taken along line 2-2 of FIG. 3 with the elements of the injector being shown with the plunger of the pump thereof positioned prior to the start of a pump stroke and the electromagnetic means thereof de-energized.

The intensified fuel or discharge passage means further includes a branch passage 37 extending from stepped passage 32 for supplying fuel to an accumulator chamber 38 in the accumulator cage 12 and a branch passage 40, that extends from stepped through passage 33 in cross-over cage 11 for supplying fuel to a spring chamber 41 provided in one end, the upper and as seen in FIG. 2 of the modulation pressure control and spring cage 10.

With this arrangement, during a pump stroke of plunger 2, part of the fuel at an intensified pressure discharged threrefrom is delivered via the discharge passage means to the accumulator chamber 38 in the accumulator cage 12. As shown, this cage is of inverted cup shape with a bored opening extending from one end thereof to provide a cylindrical inner wall 42 to slidably receive an accumulator piston 43, this piston 43 forming with the inner wall 42 the accumulator chamber 38 adjacent to the closed, upper end of the accumulator cage 12. A rate spring 44 positioned within the recessed opening of the accumulator cage 12 normally biases the accumulator piston 43 in an axial direction whereby to reduce the volume of fluid in the accumulator chamber 38.

Fuel at an intensified pressure is also supplied to the valve body 8 of the injection nozzle assembly at the lower end of the subject unit injector for injecting fuel into the engine combustion chamber, not shown, with which it is associated. In the embodiment illustrated, the valve body 8, as seen in FIG. 2, is provided with a central stepped bore therethrough which provides in the construction shown, in sequence, an internal annular stepped wall 45 extending a predetermined distance from the upper end of the valve body, an internal annular wall 46 of reduced diameter relative to the wall 45, the annular wall 46 terminating at an annular valve seat 47 encircling a spray tip passage 48 connecting to one or more spray tip orifices 50 which open to an engine combustion chamber, not shown.

Flow through the spray tip passage 48 and thus through orifices 50 is controlled by a needle type, injection valve 51 which has its large diameter intermediate stem piston portion 51*a*, of predetermined diameter, slidably journalled in the valve guide provided by a portion of wall 45, the lower stem portion 51*b* of this valve forming with the wall 46 of an annular fuel chamber 52 that is supplied with fuel at an intensified pressure via the drilled passages 36, each of these passages intersecting the fuel chamber 52 for supplying fuel thereto. The upper end of the injection valve 51 is provided with a stepped reduced diameter extension 51*c* which extends through a modulation pressure control chamber 53 and then through an apertured opening 54 in the lower end of the modulation pressure control and spring cage 10 to project into a spring chamber 41 at the opposite end of the modulation pressure control and spring cage 10 from the control chamber 53.

As shown, the stepped reduced diameter extension 51*c* of the injection valve 51 slidably extends through the opening 54 into the spring chamber 41 to abut against a spring seat 55 positioned therein. Compressed between the spring seat 55 and the lower face of the cross-over cage 11 is a coil rate spring 56 which normally biases the injection valve 51 to its closed position shown. In addition, a throttling orifice passage 57, extending through the intermediate radial wall of the modulation pressure control and spring cage 10, connects the spring chamber 41 in controlled fluid flow communication with modulation pressure control chamber 53. With this arrangement, the lower end of the piston portion 51*a* of the injection valve 51 is exposed to fuel pressure in the fuel chamber 52, its upper end to the modulated pressure of fuel, to be described, in the modulation pressure control chamber 53, while the upper end of the injection valve extension 51*c* is exposed to fuel pressure in the spring chamber 41.

Modulation of the fuel pressure in the modulation pressure control chamber 53 is obtained by connection of this chamber via a modulated pressure passage means to a fuel drain passage means for fuel at reduced pressure. The modulated pressure passage means includes an outlet passage 58 from the chamber 53 and intersects passage 60 in the modulation pressure control and spring cage 10, this latter passage 60 connecting in flow registration with a passage 61 provided in cross-over cage 11, passage 62 through accumulator cage 12, a passage 63 in bushing 7 and a passage 64 in housing 1 that opens into one end of a flow compartment or chamber 65 formed in the housing 1 by a counterbored stepped opening extending from one end of a side housing extension 1*a* of this housing.

Flow from the flow compartment or chamber 65 to a low pressure fuel return line is controlled by a normally closed, electromagnetic actuated valve, in the form of a solenoid valve, and by a metering orifice. In the construction illustrated, a valve cage 66, threadingly secured in the housing extension 1*a* is provided with a stepped bored passage 67 therethrough having a metering orifice 68 at one end therein, of predetermined diameter, opening into compartment 65, the enlarged portion of passage 67 slidably receiving the fluted end of a normally closed, solenoid actuated valve 70 which has a tip at one end, the right-hand end as seen in FIG. 2, adapted to engage the valve seat 71 that encircles the portion of passage 67 containing metering orifice 68. The opposite end of the valve 70 extends through the open end of a movable, cup shaped, solenoid armature 72 and is fixed against axial movement relative thereto by an annular retainer 73, that, for example, is press fitted onto the stem end of the valve 70.

The armature 72 is slidably received in the tubular solenoid bobbin 74 which has a magnetic wire solenoid coil 75 wrapped around it and which is connected by a pair of electrical leads 76 to a suitable source of electrical power via a conventional fuel injection electronic control circuit, not shown, whereby the solenoid can be energized as a function of operating conditions of the engine in a well known manner.

Bobbin 74 is positioned in the bore cavity of the housing extension 1*a* between the inner shoulder 1*b* of the housing extension 1*a* and a solenoid pole or core 77 threaded at 78 to the internally threaded portion bore cavity in housing extension 1*a*. The reduced diameter portion of the core 77 with its cross-slotted end 77*a* extends a predetermined axial distance into the bobbin 74 and serves as a stop for limiting axial movement of the armature 72 in one direction, to the left as seen in FIG. 2, when the solenoid is energized, suitable shims 80 being positioned, as necessary, between the bobbin 74 and core 77. As shown, the armature 72 and therefore the valve 70 are normally biased axially in the opposite direction, to the right as seen in FIG. 2, by a compression spring 81 positioned in the recessed, open end of the armature 72.

The interior of the bobbin 74 between the free end of the valve cage 66 and the one end of the armature 72 to which the valve 70 is attached forms with these elements a fuel return or drain chamber 82 that is in communication via passages 83 in armature 72 with the chamber at the opposite open end of the armature 72 containing the spring 81.

Figure 3:
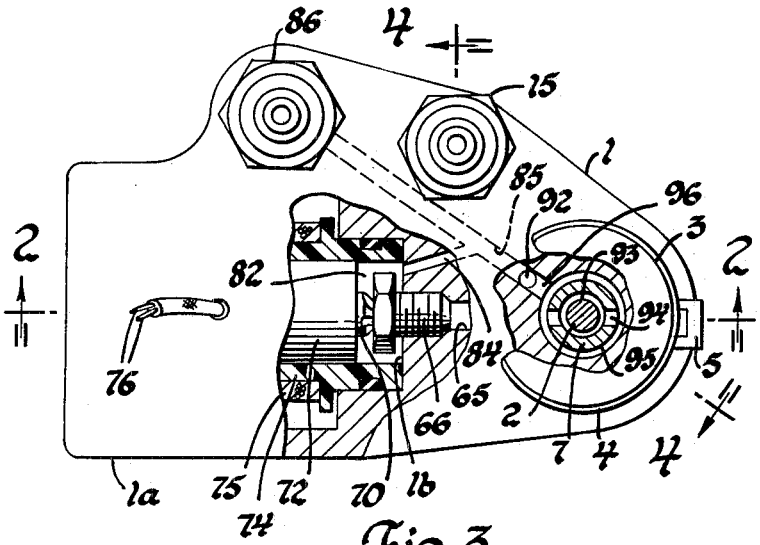
FIG. 3 is a top view of the subject electromagnetic unit fuel injector with portions broken away to show the structural relationship of various elements of the injector.

The fuel return or drain chamber 82 forms part of a fuel drain passage means, for the return of fuel to the fuel tank used to supply fuel to the unit injector, which includes a fuel drain passage 84 opening into chamber 82 through shoulder 1*b*, as seen in FIG. 3, that connects via a return passage 85 in housing 1 to the apertured fuel outlet or drain fitting 86 fixed to housing 1 and which is adapted to be connected by the usual fuel drain conduit, not shown, to the fuel tank, not shown, for the engine.

Figure 6:
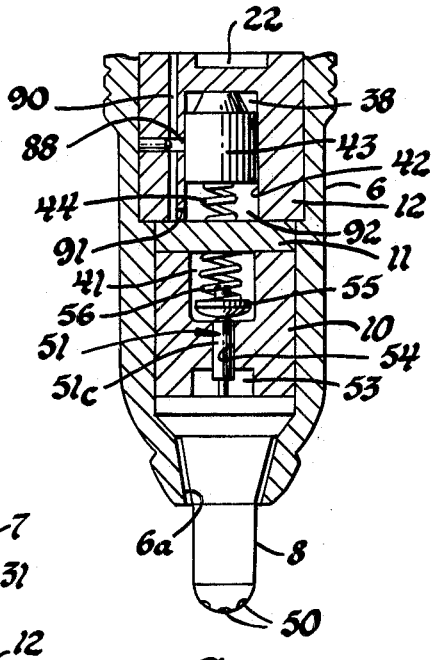
FIG. 6 is a partial sectional view taken along line 6—6 of FIG. 5.

The accumulator piston 43 as slidably received within the accumulator cage 12 also acts as a pressure relief valve since upon downward movement of this accumulator piston, from its position shown in FIGS. 1, 2 and 6, it will uncover a side relief port 88, located a predetermined axial distance from the upper end of the accumulator chamber 38. This relief port 88 connects to a portion of the fuel drain passage means which also includes a drain passage 90 extending axially through the accumulator cage 12. At one end, its lower end as seen in FIG. 6, the drain passage 90 is also connected by a side port 91 to the passage 92 on the opposite side of the accumulator piston 43 from accumulator chamber 38 and, at its opposite end, the drain passage 90 is in flow communication with a drain passage, not shown except schematically in FIG. 1, extending through the bushing 7 that is in alignment with a vertical drain passage 92 in the housing 1 which in turn communicates with the previously described passage 85 extending to the apertured drain fitting 86. Bypass leakage from the plunger accumulates in an undercut annulas 93 formed intermediate the ends of the plunger 2 and flows through radial passages 94 to a recessed annulus 95 on the outer peripheral surface of the bushing 7, the annulus 95 being suitably ported through a passage 96 intersecting the drain passage 92, as shown in FIG. 3.

Suitable seals 97 and 98 are provided for sealing engagement between the bobbin 74 and housing extension 1*a* and bobbin 74 and core 77, respectively, and a seal 99 is used for sealing engagement between housing 1 and nut 6.

FUNCTIONAL DESCRIPTION

Referring now to the drawings and, in particular, to FIG. 1, low pressure fuel, at a predetermined pressure as provided by a supply pump, not shown, is supplied to the supply fitting 15 and through the inlet passage means including filter 17 into the pressure intensification pump chamber via the open end of the bushing 7 wherein the fuel pressure is intensified to a substantially higher supply pressure $P_s$, for example, 15,000 psi, during the downward stroke of the follower 3 moving the plunger 2 on its pump stroke within the bushing 7. The high fuel pressure as thus developed flows through the discharge passage means, as controlled by ball check valve 27 to the fuel chamber 52 surrounding the lower end of injection valve 51 in the valve housing 8. In the cross-over cage 11, the high fuel pressure flows through branch passage 40 into the spring chamber 41 and then from spring chamber 41 into the modulation pressure control chamber 53 through the throttling orifice passage 57 at a controlled flow rate as controlled by the predetermined size of the throttling orifice passage 57. In a static condition, the modulation pressure level of fuel, in the modulation pressure control chamber 53 is the same as the intensified supply pressures retained in the modulation pressure passage means between the solenoid actuated valve 70 and the modulation pressure control chamber 53. The quantitative intensified supply pressure is also stored by the displacement of the accumulator piston 43 against the biasing action of spring 44 by the supply of fuel under intensified pressures flowing through the branch passage 37 into the accumulator chamber 38.

An electrical (current) pulse of finite characteristic and duration (timed relative to top-dead-center of engine piston position with respect to the camshaft and injector rocker arm linkage, not shown) applied through the leads 76 to the coil 75 produces an electromagnetic field attracting the armature 72 to the core 77 raising the solenoid actuated valve 70 from its valve seat 71 to permit flow of fuel through the metering orifice 68 from the modulation pressure control chamber 53. The rate of pressure drop in the modulation passage means and in the modulator pressure control chamber 53 is determined by the diameter ratio of the metering orifice 68 and the throttling orifice passage 57, previously predetermined, and, when the pressure decay rate in the modulation pressure control chamber 53 reaches the spray tip injection valve 51 opening pressure level $P_o$, this injection valve "pops" from its valve seat 47 to effect injection of fuel out through the spray tip orifices 50. The rate of modulation pressure decay determines and controls the velocity of the injection valve 51 lift and hence the pressure-rate injection profile of this unit injector.

The fuel passing through the solenoid valve controlled modulating fuel pressure passage means into the fuel return chamber 82 drops to the low pressure of fuel present in the fuel drain passage means, since the drain fitting 86 is directly connected by a fuel return or drain conduit, not shown, to a fuel tank, also not shown, in which fuel is stored at a pressure corresponding substantially to atmospheric pressure. Also, drainage from the chamber below the accumulator piston 43 flows into the fuel return drain passage means to drain back to the fuel tank. As previously described, fuel bypass leakage from around the plunger 2 accumulates in the annulus 93 and flows through the radial passages 94 to the annulus 95 which is ported to the fuel return drain passage means through the passage 96. In the event relief port 88 is uncovered by accumulator piston 43 due to an excess quantity of high pressure fuel flowing into accumulator chamber 38, excess fuel from this chamber will flow through the relief port into the fuel return drain passage means.

Termination of the electrical pulse to the coil 75 collapses the electromagnetic force between the core 77 and armature 72. As this occurs, the force of the rate spring 81 provides a fast response closure of the valve 70 against valve seat 71 causing the modulation pressure in chamber 53 to rise to the spray tip injection valve 51 closure pressure $P_c$. The opening pressure $P_o$ and the closing pressure $P_c$ are defined by the following formulas:

$$P_o = \frac{P_s(\text{Area } B - \text{Area } C) - F_l}{(\text{Area } B - \text{Area } A)}$$

$$P_c = \frac{P_5(\text{Area } B) - F_l}{(\text{Area } A)}$$

wherein, as seen in FIG. 1:

$P_m$ = modulation pressure in modulation pressure control chamber 53 = $P_o$ valve opening pressure = $P_c$ valve closing pressure $P_s$ = supply pressure delivered by plunger 2

$A_A$ = effective area of reduced diameter valve extension 5/c of injection valve 51

$A_B$ = effective area of enlarged diameter stem piston portion 5/a of injection valve 51

$A_C$ = effective area of lower reduced diameter stem portion 5/b of injection valve 51

$F_1$ = force of spring 56 in spring chamber 41 acting to bias injection valve 51 to its closed position.

The response control of the subject electromagnetic unit fuel injector is such as to permit pilot injection with minimum durations of 0.2 millisecond, electronically timed with respect to the camshaft position (T.D.C.) on a system RPM/load schedule.

The subject electromagnetic unit fuel injector structure disclosed herein features the basic injection nozzle and rate spring cage control of the opening and closing of the injection valve 51, in a manner similar to conventional injection nozzle assemblies, but in addition it is operative so as to control the velocity rate of injection valve 51 lift with the modulated pressure of fuel in the modulation pressure control chamber 53 and, hence, to control the injection response characteristic, including the pressure rate of fuel injection, as desired.

It will be apparent to those skilled in the art that numerous changes and modifications can be made to the preferred embodiment of the subject electromagnetic unit fuel injector illustrated, without departing from the teaching of this invention. For example, the metering orifice 68, instead of being provided in the valve cage 66, as illustrated, can readily be positioned anywhere in the modulated fuel passage means between the modulation pressure control chamber 53 and the solenoid actuated valve 70.

As another example, the plunger 2 and bushing 7 could be modified so as to provide the plunger with the usual helices to cooperate with ports in the bushing for control of fuel flow to and from the pump cylinder in a well-known manner, it only being necessary in such a modification to provide for the discharge of a predetermined excess of fuel into the accumulator chamber of the subject unit injector so that fuel injection can be controlled by energization and de-energization of the electromagnetic portion of this unit injector in the manner described during all modes of engine operation, and to provide for the desired cooling of the various elements of the unit by the flow of excess fuel therethrough.

What is claimed is:

1. An electromagnetic unit fuel injector - pump assembly including a housing means having a fuel inlet and a fuel drain outlet at one end thereof, said housing means at its other end including a valve body having a spray outlet at its free end, a pump bushing in said housing means, a plunger reciprocable in said bushing, said bushing being open at one end for the ingress and egress of fuel during reciprocation of said plunger, a valve controlled inlet passage means in said housing means connecting said inlet to said open end of said bushing, discharge passage means including a one-way valve connected at one end to said open end of said bushing and in communication at its other end with said spray outlet, an injection valve slidably journaled in said housing means to control flow out through said spray outlet, a pressure accumulator chamber in said housing means, an accumulator piston reciprocably positioned in said pressure accumulator chamber, passage means connecting said discharge passage means to one end of said pressure accumulator chamber, drain passage means in said housing means connected at one end to said drain outlet and at its other end to the opposite end of said pressure accumulator chamber, a spring in said pressure accumulator chamber normally biasing said accumulator piston toward said end of said pressure accumulator chamber in communication with said discharge passage means, a spring cage chamber in said housing means in fluid communication at one end with said discharge passage means, a modulation pressure control chamber in said housing means positioned between said spring cage chamber and said spray outlet, a guide bore in said housing means extending between said spring cage chamber and said modulation pressure chamber, said injection valve having a piston portion reciprocally journaled in said guide bore with one end thereof extending into said modulation pressure chamber and a reduced diameter extension portion thereof extending into said spring cage chamber, spring means in said spring cage chamber abutting against said extension portion of said injection valve whereby to bias said injection valve into closing engagement relative to said spray outlet, a throttling orifice passage in said housing means connecting said spring chamber in fluid communication with said modulating pressure control chamber, a modulated pressure passage means in said housing means connected at one end to said modulation pressure control chamber, a drain chamber in said housing means, said modulated pressure passage means including a metering orifice opening into said drain chamber, solenoid actuated valve means including a valve positioned to control the flow of fluid through said metering orifice into said drain chamber and, drain passage means connecting said drain chamber to said fuel drain outlet.

2. An electromagnetic unit fuel injector - pump assembly including a housing means having a fuel inlet and a fuel drain outlet at one end thereof and including a valve body terminating in a spray outlet at its other end, a pump cylinder in said housing means, a plunger reciprocable in said cylinder, said cylinder being open at one end for the ingress and egress of fuel during reciprocation of said plunger, a valve controlled inlet passage means in said housing means connecting said inlet to said open end of said cylinder, discharge passage means connected at one end to said open end of said cylinder, a one-way valve in said outlet passage means adjacent said one end thereof, said discharge passage means terminating at its other end at said spray outlet, an injection valve in said delivery passage means having one end thereof in position to close said spray outlet, a pressure accumulator chamber in said housing means, an accumulator piston reciprocal in said pressure accumulator chamber, conduit means connecting said discharge passage means to one end of said pressure accumulator chamber, drain passage means in said housing means connected at one end to said drain outlet, drain conduit means connecting the opposite end of said pressure accumulator chamber to said drain passage means, spring means in said pressure accumulator chamber normally biasing said accumulator piston toward said end of said pressure accumulator chamber in communication with said discharge passage means, a modulation pressure control chamber in said housing means, said injection valve having its other end thereof projecting into said modulation pressure control chamber, a rate spring means operatively positioned in said housing means to normally bias said injection valve in a direction to close said spray outlet, a throttling orifice passage connecting said discharge passage means to said modulation pressure control chamber, a fuel drain chamber, said drain passage means being in communication with said fuel drain chamber and, conduit means including a solenoid actuated valve controlled metering orifice passage connected to said drain chamber and at its other end in fluid communication with said modulation pressure control chamber.

3. An electromagnetic unit fuel injector including a housing means having a fuel inlet and a fuel drain outlet at one end thereof and including a valve body, terminating in a spray outlet at its other end, a pump cylinder in said housing means, a plunger reciprocable in said cylinder, said cylinder having an open end for the ingress and egress of fuel during reciprocation of said plunger, a valve controlled inlet passage means in said housing means connecting said inlet to said cylinder open end, discharge passage means having a check valve therein connected at one end to said cylinder open end with said check valve next adjacent thereto, said discharge passage means including an injection fuel delivery passage in said valve body terminating at said spray outlet, an injection valve movable in said valve body with one end thereof movable between a closed position and an open position relative to said spray outlet, a pressure accumulator means in said housing means having one end thereof in communication with said discharge passage means, drain passage means in said housing means connected at one end to said drain outlet and including drain conduit means connected to the opposite end of said pressure accumulator means, a modulation pressure control chamber in said housing means, said injection valve having an enlarged diameter portion thereof projecting into said modulation pressure control chamber, a spring means operatively connected to said injection valve to move said injection valve to said closed position, a throttling orifice passage connecting said discharge passage means to said modulation pressure control chamber, a drain chamber, said drain passage means being in communication with said drain chamber, and solenoid valve controlled modulated pressure passage means including a metering orifice therein operatively connected at one end to said modulation pressure control chamber downstream of said throttling orifice and at its other end connected in fluid communication with said drain chamber.

4. An electromagnetic unit fuel injector including a housing means having a fuel inlet and a fuel drain outlet, a pump cylinder in said housing means, a cam actuated plunger reciprocable in said cylinder, said cylinder being open at one end for discharge of fuel displaceable by said plunger during a pump stroke and for fuel intake during a suction stroke of said plunger, a valve controlled fuel inlet passage means connecting said fuel inlet to said cylinder open end, a fuel injector including a valve body carried by said housing means, said valve body having a spray outlet at one end thereof for the discharge of fuel, an injection valve movable in said valve body between an open position and a closed position relative to said spray outlet, a discharge passage means having a check valve therein connecting said cylinder open end to said spray outlet, a modulation pressure control chamber means in said housing means, a bore in said valve body slidably guiding said injection valve and opening into said modulation pressure control chamber means, said injection valve having a piston portion exposed to fuel pressure in said discharge passage means adjacent said spray outlet for effecting movement of said injection valve to said open position, a spring means positioned in said housing means for abutment against one end of said injection valve to bias said injection valve to said closed position, said discharge passage means including a throttling orifice passage connected to said modulation pressure control chamber means, a drain passage means including a drain chamber means connected at one end to said fuel drain outlet, modulated pressure passage means connected at one end to said one end of said modulation pressure control chamber means and connected at its opposite end to said drain chamber means of said drain passage means, said modulated pressure passage means including a solenoid valve controlling flow through a metering orifice whereby to control the pressure in said modulation pressure control chamber means acting on said piston portion whereby to control the movement of said injection valve between said open position and said closed position, and pressure accumulator means in said housing means in communication with said discharge passage means, said pressure accumulator means being operative to store fuel under pressure during a pump stroke of said plunger.

5. An electromagnetic unit fuel injector including a housing means having a fuel inlet and a fuel drain outlet at one end thereof, a fuel injector including a valve body carried by said housing means at its opposite end, said valve body having a spray outlet at one end exterior of said housing means, an injection valve movable in said valve body to open and close said spray outlet, a pump cylinder in said housing means, a cam actuated plunger reciprocable in said cylinder, said cylinder having an open end for the ingress and egress of fuel during a suction stroke and a pumping stroke, respectively, of said plunger, a valve controlled inlet passage means in said housing means connecting said inlet to said cylinder open end, discharge passage means having a check valve therein connected at one end to said cylinder open end and at its other end terminating at said spray outlet, said check valve being positioned next adjacent to said cylinder open end, a pressure accumulator chamber in said housing means connected at one end to said discharge passage means downstream of said check valve, an accumulator piston slidably journaled in said pressure chamber, a spring means positioned in said chamber to abut against said accumulator piston whereby fuel discharged during a pump stroke of said plunger can be stored under pressure within said pressure accumulator chamber, a modulation pressure control chamber in said housing means, a spring means in said housing means operatively positioned for biasing said injection valve to the closed position, said discharge passage means further including a throttling orifice passage connected to said modulation pressure control chamber, a drain passage means connected at one end to said fuel drain outlet, a modulated pressure passage means including a solenoid actuated valve controlled metering orifice connected at one end to said modulation pressure control chamber, the opposite end of said modulated pressure passage means being connected to an opposite end of said drain passage means.

* * * * *